US010314339B2

(12) United States Patent
Fraser

(10) Patent No.: US 10,314,339 B2
(45) Date of Patent: Jun. 11, 2019

(54) ELECTRONIC VAPOR PROVISION SYSTEM

(71) Applicant: Nicoventures Holdings Limited, London (GB)

(72) Inventor: Rory Fraser, London (GB)

(73) Assignee: Nicoventures Holdings Limited, London (GB)

( * ) Notice: Subject to any disclaimer, the term of this patent is extended or adjusted under 35 U.S.C. 154(b) by 0 days.

(21) Appl. No.: 15/321,040

(22) PCT Filed: Jul. 21, 2015

(86) PCT No.: PCT/GB2015/052100
§ 371 (c)(1),
(2) Date: Dec. 21, 2016

(87) PCT Pub. No.: WO2016/012774
PCT Pub. Date: Jan. 28, 2016

(65) Prior Publication Data

US 2017/0224014 A1 Aug. 10, 2017

(30) Foreign Application Priority Data

Jul. 22, 2014 (GB) ..... 1412954.8

(51) Int. Cl.
*A24F 47/00* (2006.01)
*H05B 1/02* (2006.01)

(52) U.S. Cl.
CPC ..... *A24F 47/008* (2013.01); *H05B 1/0244* (2013.01); *H05B 2203/021* (2013.01)

(58) Field of Classification Search
CPC ..... A24F 47/008
See application file for complete search history.

(56) References Cited

U.S. PATENT DOCUMENTS 9,326,547 B2 * 5/2016 Tucker ..... H01C 17/00
2014/0261486 A1 * 9/2014 Potter ..... A24F 47/008 131/328

(Continued)

FOREIGN PATENT DOCUMENTS

CN 202722502 U 2/2013
CN 103181622 A 7/2013

(Continued)

OTHER PUBLICATIONS

International Search Report for corresponding International Application No. PCT/GB2015/052100 dated Oct. 28, 2015; 4 pages.

(Continued)

*Primary Examiner* — Abdullah A Riyami
*Assistant Examiner* — Nader J Alhawamdeh
(74) *Attorney, Agent, or Firm* — Patterson Thuente Pedersen, P.A.

(57) ABSTRACT

An electronic vapor provision system includes a housing, a vaporizer contained within the housing, and a mouthpiece at one end of the system. The mouthpiece provides an air outlet. At least one air inlet hole is provided in a portion of the housing. In response to a user inhalation at the mouthpiece, air flows into the system through the one or more air inlet holes, past the vaporizer, and out through the mouthpiece. The system further includes a collar located around the portion of the housing in which the one or more air inlet holes are provided. The collar is movable with respect to the housing. The system further includes a mechanism for positively engaging the collar and the housing at a plurality of predetermined positions as the collar is moved with respect to the housing. Different ones of the plurality of predetermined positions result in different degrees of alignment between the one or more air inlet holes of the housing (Continued)

and the collar, thereby providing different levels of ventilation into the system.

23 Claims, 5 Drawing Sheets

(56) References Cited

U.S. PATENT DOCUMENTS

| | | | | |
|---|---|---|---|---|
| 2014/0360517 | A1* | 12/2014 | Taggart | A24F 47/008 131/329 |
| 2015/0164147 | A1* | 6/2015 | Verleur | A24F 47/008 131/329 |
| 2016/0262452 | A1* | 9/2016 | Zhu | A24F 47/008 |

FOREIGN PATENT DOCUMENTS

| | | | | |
|---|---|---|---|---|
| CN | 203168032 | U | 9/2013 | |
| CN | 203505589 | U | 4/2014 | |
| CN | 203505590 | U | 4/2014 | |
| CN | 203538369 | U | 4/2014 | |
| DE | 10 2012 111 476 | A1 | 5/2014 | |
| DE | 102012111476 | A1 * | 5/2014 | A24F 47/008 |
| EP | 0 845 220 | A1 | 6/1998 | |
| KR | 10-2012-0056095 | | 1/2013 | |
| WO | WO 2013/147492 | A1 | 3/2013 | |
| WO | WO 2013/083635 | A1 | 6/2013 | |
| WO | WO 2013/083636 | A1 | 6/2013 | |

OTHER PUBLICATIONS

Written Opinion of the International Searching Authority for corresponding International Application No. PCT/GB2015/052100 dated Oct. 7, 2016; 6 pages.

Written Opinion of the International Preliminary Examining Authority for corresponding International Application No. PCT/GB2015/052100 dated Jun. 13, 2016; 8 pages.

International Preliminary Report on Patentability for corresponding International Application No. PCT/GB2015/052100 dated Oct. 28, 2015; 17 pages.

Search Report for corresponding GB Application No. 1412954.8 dated Jan. 29, 2015; 5 pages.

Chinese Office Action, Application No. 201580039931.5, dated Aug. 15, 2018, 10 pages (24 pages with translation).

* cited by examiner

ELECTRONIC VAPOR PROVISION SYSTEM

CROSS-REFERENCE TO RELATED APPLICATIONS

The present application is a National Phase entry of PCT Application No. PCT/GB2015/052100, filed on 21 Jul. 2015, which claims priority to GB Patent Application No. 1412954.8, filed on 22 Jul. 2014, which are hereby fully incorporated herein by reference.

TECHNICAL FIELD

The present disclosure relates to electronic vapor provision systems such as electronic nicotine delivery systems, including e-cigarettes.

BACKGROUND

Electronic vapor provision systems such as e-cigarettes generally contain a reservoir of liquid which is to be vaporized, for example, nicotine. When a user inhales on the device, a heater is activated to vaporize a small amount of liquid, which is then inhaled by the user through a mouthpiece. More particularly, such devices are usually provided with one or more air inlet holes located away from the mouthpiece. When a user sucks on the mouthpiece, air is drawn in through the inlet holes and past the vapor source, such as the heater supplied with nicotine or other liquid from a cartridge.

In some known devices, the user can exercise a certain degree of control over the air inflow into the device. Such control may be utilized, for example, to alter the draw resistance of the device. An electronic vapor provision system should provide a user with an airflow control mechanism that helps to achieve ease-of-use and reliability.

SUMMARY

The invention is defined in the appended claims.

Some embodiments of the disclosure provide an electronic vapor provision system that comprises a housing, a vaporizer contained within the housing, and a mouthpiece at one end of said system. The mouthpiece provides an air outlet. One or more air inlet holes are provided in a portion of the housing. In response to a user inhalation at the mouthpiece, air flows into the system through the one or more air inlet holes, past the vaporizer, and out through the mouthpiece. The system further includes a collar located around the portion of the housing in which the one or more air inlet holes are provided. The collar is movable with respect to the housing. The system further includes a mechanism for positively engaging the collar and the housing at a plurality of predetermined positions as the collar is moved with respect to the housing. Different ones of said plurality of predetermined positions result in different degrees of alignment between the one or more air inlet holes of the housing and the collar, thereby providing different levels of ventilation into the system.

Other embodiments provide an electronic vapor provision system having one or more air inlet holes for drawing air into the system in response to a user inhalation and a variable ventilation mechanism having a plurality of predetermined settings, wherein each setting corresponds to a different degree of occlusion of the one or more air inlet holes, and the variable ventilation mechanism can be latched into any of said plurality of predetermined settings.

Other embodiments provide a body portion and/or a vaporizer portion for an electronic vapor provision system according to one of the above embodiments.

The approach described herein is not restricted to specific embodiments such as set out below, but includes and contemplates any appropriate combinations of features presented herein. For example, an electronic vapor provision system may be provided in accordance with the approach described herein which includes any one or more of the various features described below as appropriate.

BRIEF DESCRIPTION OF THE DRAWINGS

Various embodiments of the disclosure will now be described in detail by way of example only with reference to the following drawings.

DETAILED DESCRIPTION

Figure 1:
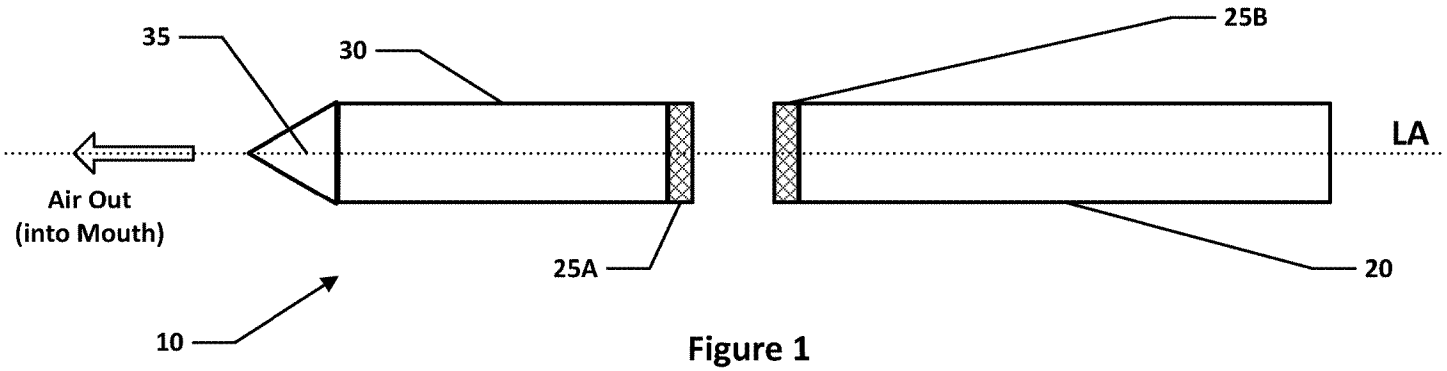
FIG. 1 is a schematic (exploded) diagram of an electronic vapor provision system such as an e-cigarette in accordance with some embodiments of the disclosure.

FIG. 1 is a schematic diagram of an electronic vapor provision system such as an e-cigarette 10 in accordance with some embodiments of the disclosure (not to scale). The e-cigarette 10 has a generally cylindrical shape, extending along a longitudinal axis indicated by dashed line LA, and comprises two main components, namely a body 20 and a cartomizer 30. The cartomizer includes an internal chamber containing a reservoir of nicotine, a vaporizer (such as a heater), and a mouthpiece 35. The reservoir may be a foam matrix or any other structure for retaining the nicotine until such time that it is required to be delivered to the vaporizer. The cartomizer 30 also includes a heater for vaporizing the nicotine and may further include a wick or similar facility to transport a small amount of nicotine from the reservoir to a heating location on or adjacent the heater.

The body 20 includes a re-chargeable cell or battery to provide power to the e-cigarette 10 and a circuit board for generally controlling the e-cigarette 10. When the heater receives power from the battery, as controlled by the circuit board, the heater vaporizes the nicotine and this vapor is then inhaled by a user through the mouthpiece.

The body 20 and cartomizer 30 are detachable from one another by separating in a direction parallel to the longitudinal axis LA, as shown in FIG. 1, but are joined together when the device 10 is in use by a connection, indicated schematically in FIG. 1 as 25A and 25B, to provide mechanical and electrical connectivity between the body 20 and the cartomizer 30. The electrical connector on the body 20 that is used to connect to the cartomizer 30 also serves as a socket for connecting a charging device (not shown) when the body 20 is detached from the cartomizer 30. The other end of the charging device can be plugged into a USB socket to re-charge the cell in the body 20 of the e-cigarette 10. In other implementations, a cable may be provided for direct connection between the electrical connector on the body 20 and a USB socket.

The e-cigarette 10 is provided with one or more holes (not shown in FIG. 1) for air inlet. These holes connect to an air passage through the e-cigarette 10 to the mouthpiece 35. When a user inhales through the mouthpiece 35, air is drawn into this air passage through the one or more air inlet holes, which are suitably located on the outside of the e-cigarette 10. This airflow (or the resulting change in pressure) is detected by a pressure sensor that in turn activates the heater to vaporize the nicotine from the cartridge. The airflow passes through, and combines with, the nicotine vapor, and this combination of airflow and nicotine vapor then passes out of the mouthpiece 35 to be inhaled by a user. The cartomizer 30 may be detached from the body 20 and disposed of when the supply of nicotine is exhausted (and replaced with another cartomizer if so desired).

It will be appreciated that the e-cigarette 10 shown in FIG. 1 is presented by way of example, and various other implementations can be adopted. For example, in some embodiments, the cartomizer 30 is provided as two separable components, namely a cartridge comprising the nicotine reservoir and mouthpiece (which can be replaced when the nicotine from the reservoir is exhausted), and a vaporizer comprising a heater (which is generally retained). As another example, the charging facility may connect to an additional or alternative power source, such as a car cigarette lighter.

Figure 2:
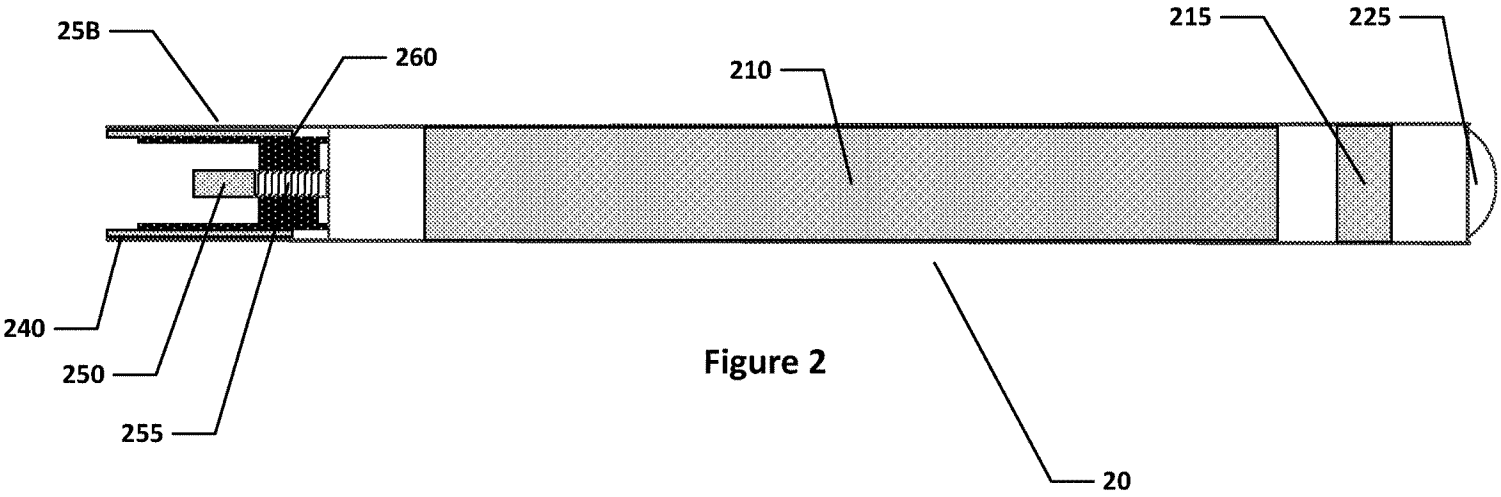
FIG. 2 is a schematic diagram of the body of the e-cigarette of FIG. 1 in accordance with some embodiments of the disclosure.

FIG. 2 is a schematic (simplified) diagram of the body 20 of the e-cigarette 10 of FIG. 1 in accordance with some embodiments of the disclosure. FIG. 2 can generally be regarded as a cross-section in a plane through the longitudinal axis LA of the e-cigarette 10. Note that various components and details of the body 20, e.g. such as wiring and more complex shaping, have been omitted from FIG. 2 for reasons of clarity.

As shown in FIG. 2, the body 20 includes a battery or cell 210 for powering the e-cigarette 10, as well as a chip, such as an application specific integrated circuit (ASIC) for controlling the e-cigarette 10. The ASIC may be positioned alongside or at one end of the battery 210. The ASIC is attached to a sensor 215 to detect an inhalation on mouthpiece 35 (or alternatively the sensor 215 may be provided on the ASIC itself). The sensor 215 is located at an appropriate position within the e-cigarette 10, most commonly within the body portion 20, to experience a passing airflow caused by the inhalation. Such positioning is usually determined, at least in part, by the location of the air inlet(s) for the e-cigarette 10. In response to a detection of inhalation by the sensor 215, the ASIC provides power from the battery 210 to a heater in the cartomizer 30 to vaporize nicotine into the airflow which is inhaled by a user.

The body 20 further includes a cap 225 to seal and protect the far (distal) end of the e-cigarette 10. In some embodiments, there is an air inlet hole provided in or adjacent to the cap 225 to allow air to enter the body and flow past the sensor 215 when a user inhales on the mouthpiece 35. This airflow therefore allows the sensor 215 to detect the user inhalation.

At the opposite end of the body 20 from the cap 225 is the connector 25B for joining the body 20 to the cartomizer 30. The connector 25B provides mechanical and electrical connectivity between the body 20 and the cartomizer 30. The connector 25B includes a body connector 240, which is metallic (silver-plated in some embodiments) to serve as one terminal for electrical connection (positive or negative) to the cartomizer 30. The connector 25B further includes an electrical contact 250 to provide a second terminal for electrical connection to the cartomizer 30 of opposite polarity to the first terminal, namely body connector 240. The electrical contact 250 is mounted on a coil spring 255. When the body 20 is attached to the cartomizer 30, the connector 25A on the cartomizer 30 pushes against the electrical contact 250 in such a manner as to compress the coil spring in an axial direction, i.e. in a direction parallel to (co-aligned with) the longitudinal axis LA. In view of the resilient nature of the spring 255, this compression biases the spring 255 to expand, which has the effect of pushing the electrical contact 250 firmly against connector 25A, thereby helping to ensure good electrical connectivity between the body 20 and the cartomizer 30. The body connector 240 and the electrical contact 250 are separated by a trestle 260, which is made of a non-conductor (such as plastic) to provide good insulation between the two electrical terminals. The trestle 260 is shaped to assist with the mutual mechanical engagement of connectors 25A and 25B.

Figure 3:
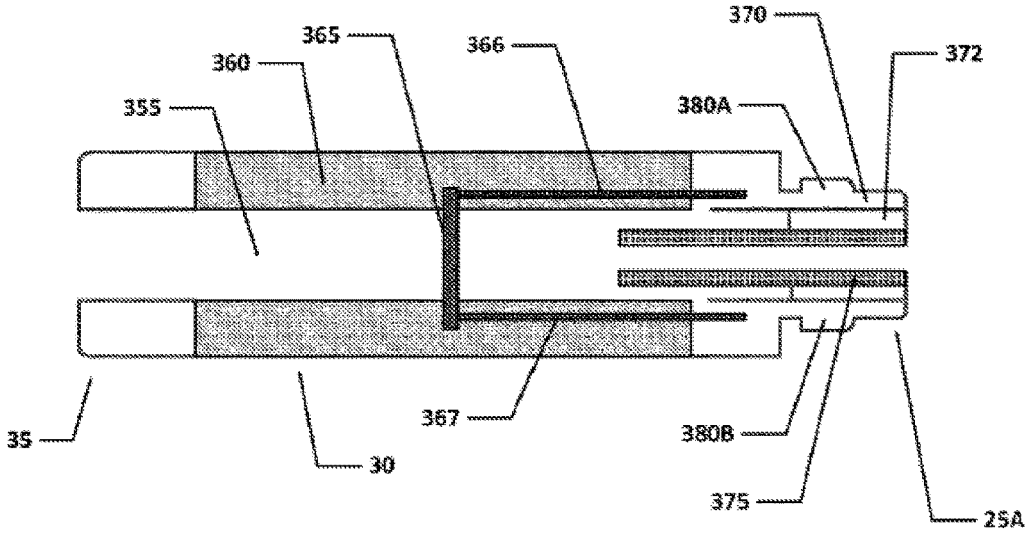
FIG. 3 is a schematic diagram of the vaporizer portion of the e-cigarette of FIG. 1 in accordance with some embodiments of the disclosure.

FIG. 3 is a schematic diagram of the cartomizer 30 of the e-cigarette 10 of FIG. 1 in accordance with some embodiments of the disclosure. FIG. 3 can generally be regarded as a cross-section in a plane through the longitudinal axis LA of the e-cigarette 10. Note that various components and details of the body 20, e.g. such as wiring and more complex shaping, have been omitted from FIG. 3 for reasons of clarity.

The cartomizer 30 includes an air passage 355 extending along the central (longitudinal) axis of the cartomizer 30 from the mouthpiece 35 to the connector 25A for joining the cartomizer to the body 20. A reservoir of nicotine 360 is provided around the air passage 335. This reservoir 360 may be implemented, for example, by providing cotton or foam soaked in nicotine. The cartomizer 30 also includes a heater 365 for heating nicotine from reservoir 360 to generate nicotine vapor to flow through air passage 355 and out through mouthpiece 35 in response to a user inhaling on the e-cigarette 10. The heater 365 is powered through lines 366 and 367, which are in turn connected to opposing polarities (positive and negative, or vice versa) of the battery 210 via connector 25A (the details of the wiring between the power lines 366 and 367 and connector 25A are omitted from FIG. 3).

The connector 25A includes an inner electrode 375, which may be silver-plated or made of some other suitable metal. When the cartomizer 30 is connected to the body 20, the inner electrode 375 contacts the electrical contact 250 of the body 20 to provide a first electrical path between the cartomizer and the body. In particular, as the connectors 25A and 25B are engaged, the inner electrode 375 pushes against the electrical contact 250 so as to compress the coil spring 255, thereby helping to ensure good electrical contact between the inner electrode 375 and the electrical contact 250.

The inner electrode 375 is surrounded by an insulating ring 372, which may be made of plastic, rubber, silicone, or any other suitable material. The insulating ring 372 is surrounded by the cartomizer connector 370, which may be silver-plated or made of some other suitable metal or conducting material. When the cartomizer 30 is connected to the body 20, the cartomizer connector 370 contacts the body connector 240 of the body 20 to provide a second electrical path between the cartomizer 30 and the body 20. In other words, the inner electrode 375 and the cartomizer connector 370 serve as positive and negative terminals (or vice versa) for supplying power from the battery 210 in the body to the heater 365 in the cartomizer 30 via supply lines 366 and 367 as appropriate.

The cartomizer connector 370 is provided with two lugs or tabs 380A, 380B, which extend in opposite directions away from the longitudinal axis of the e-cigarette 10. These tabs are used to provide a bayonet fitting in conjunction with the body connector 240 for connecting the cartomizer 30 to the body 20. This bayonet fitting provides a secure and robust connection between the cartomizer 30 and the body 20, so that the cartomizer 30 and body 20 are held in a fixed position relative to one another, without wobble or flexing, and the likelihood of any accidental disconnection is very small. At the same time, the bayonet fitting provides simple and rapid connection and disconnection by an insertion followed by a rotation for connection, and a rotation (in the reverse direction) followed by withdrawal for disconnection. It will be appreciated that other embodiments may use a different form of connection between the body 20 and the cartomizer 30, such as a snap fit or a screw connection.

Figure 4:
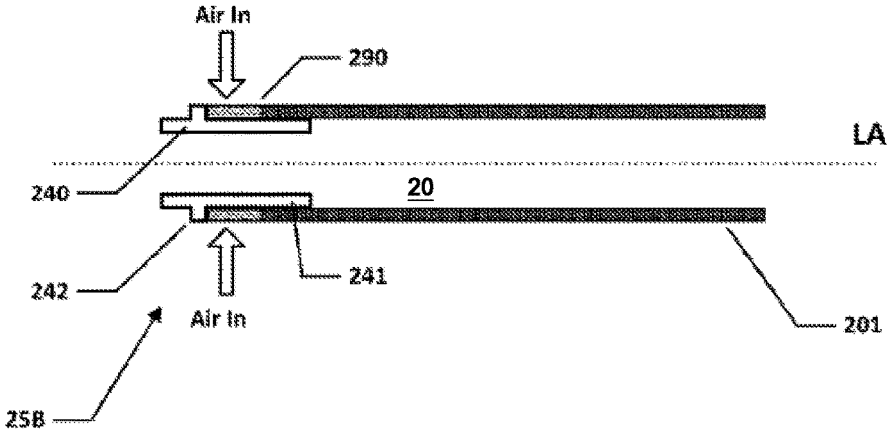
FIG. 4 is a schematic diagram showing certain aspects of one end of the body portion of the e-cigarette of FIG. 1 in accordance with some embodiments of the disclosure.

FIG. 4 is a schematic diagram of certain details of the connector 25B at the end of the body 20 in accordance with some embodiments of the disclosure (but omitting for clarity most of the internal structure of the connector as shown in FIG. 2, such as trestle 260). In particular, FIG. 4 shows the external housing 201 of the body 20, which generally has the form of a cylindrical tube. This external housing 201 may comprise, for example, an inner tube of metal with an outer covering of paper or similar.

The body connector 240 extends from this external housing 201 of the body 20. The body connector 240 as shown in FIG. 4 comprises two main portions, a shaft portion 241 in the shape of a hollow cylindrical tube, which is sized to fit just inside the external housing 201 of the body 20, and a lip portion 242 which is directed in a radially outward direction, away from the main longitudinal axis (LA) of the e-cigarette 10. Surrounding the shaft portion 241 of the body connector 240, where the shaft portion 241 does not overlap with the external housing 201, is a collar or sleeve 290, which is again in a shape of a cylindrical tube. The collar 290 is retained between the lip portion 242 of the body connector 240 and the external housing 201 of the body 20, which together prevent movement of the collar 290 in an axial direction (i.e. parallel to axis LA). However, collar 290 is free to rotate around the shaft portion 241 (and hence also axis LA).

As mentioned above, the cap 225 is provided with an air inlet hole to allow air to flow past sensor 215 when a user inhales on the mouthpiece 35. However, the majority of air that enters the device 10 when a user inhales flows through collar 290 and body connector 240 as indicated by the two arrows in FIG. 4. In some embodiments, the cap 225 may not be provided with an air inlet hole. In this case all of the air that enters the device 10 when a user inhales may flow through the collar 290 and the body connector 240 as indicated by the two arrows in FIG. 4. Alternatively, there may be other routes for air into the e-cigarette 10, for example, generally at the join between the body 20 and the cartomizer 30, and/or using one or more air inlet holes located elsewhere in the e-cigarette 10.

Figure 5:
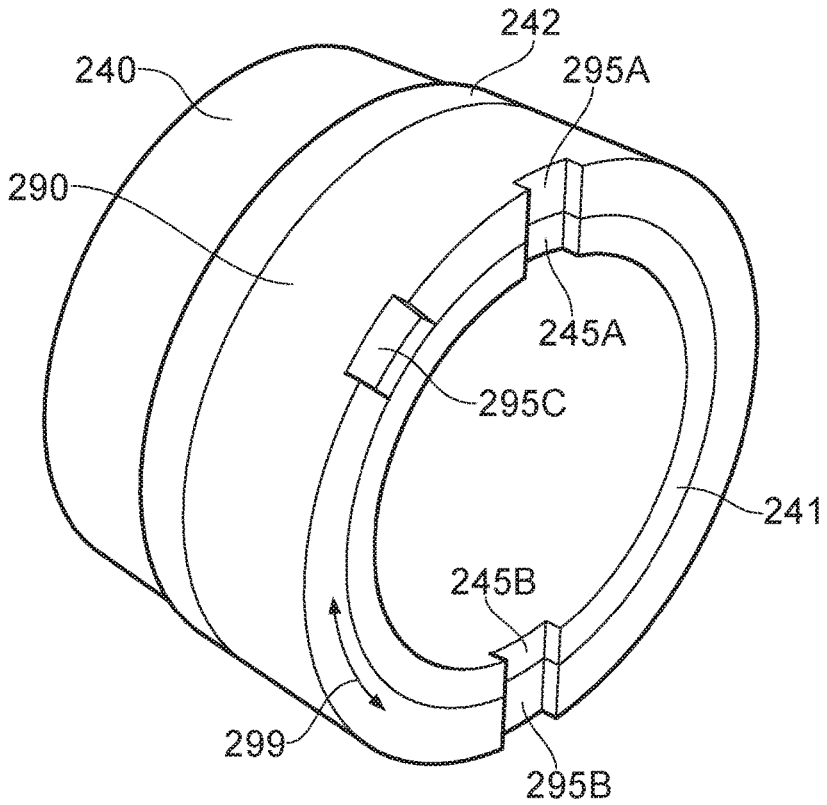
FIG. 5 is a schematic diagram showing a collar or sleeve fitted around a part of the body of the e-cigarette of FIG. 1 in accordance with some embodiments of the disclosure.

FIG. 5 illustrates how the collar 290 and body connector 240 permit air to flow into the e-cigarette 10 in accordance with some embodiments. (Note that FIG. 5 is sectioned where the body connector 240 enters the external housing 201, hence the portion of the shaft 241 of the body connector 240 that is located inside the external housing 201 is omitted from FIG. 5.)

As shown in FIG. 5, the collar 290 is provided with three notches or openings 295A, 295B and 295C, which are azimuthally spaced around the circumference of the collar 290. Each notch or opening 295A, 295B and 295C allows air to flow through the collar 290 in a radial direction, i.e. from outside the collar 290 to inside the collar 290. The shaft 241 of the body connector 240 also includes openings, in particular apertures 245A and 245B, which are likewise azimuthally spaced around the circumference of the shaft 241. Note that the portion of the shaft 241 that extends into the external housing 201 (not shown in FIG. 5) may provide the fourth side or edge of these openings, or alternatively the openings may extend into the region of the shaft 241 that overlaps the external housing 201.

As mentioned above, and as indicated by arrow 299 in FIG. 5, the collar 290 may be rotated around the longitudinal axis LA of the shaft 241 and e-cigarette 10. Such rotation alters the relative azimuthal positioning of the collar 290 and the shaft 241, including the relative azimuthal positioning of the holes therein. In particular, such rotation changes the relative alignment between the notches 295A, 295B and 295C in the collar 290 and the openings 245A and 245B in the shaft 241.

Figure 6A:
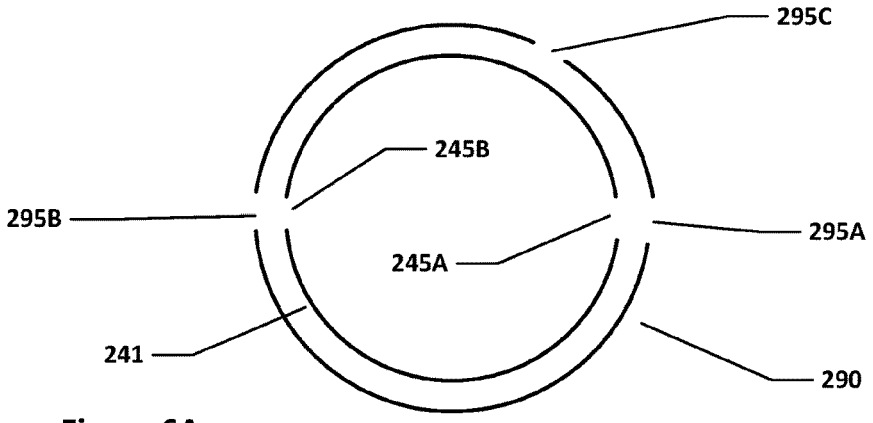
FIGS. 6A, 6B, 6C are schematic diagrams showing three different positions of the collar of FIG. 5 for providing three respective amounts of ventilation into the e-cigarette of FIG. 1 in accordance with some embodiments of the disclosure.
Figure 6B:
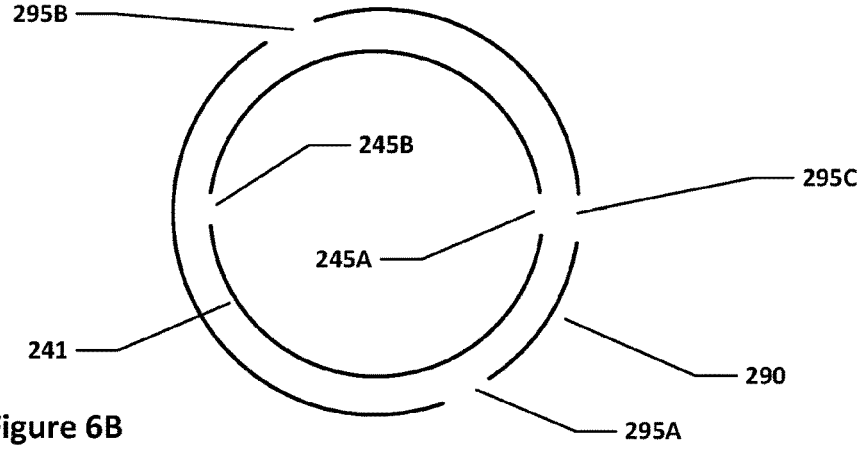
Figure 6C:
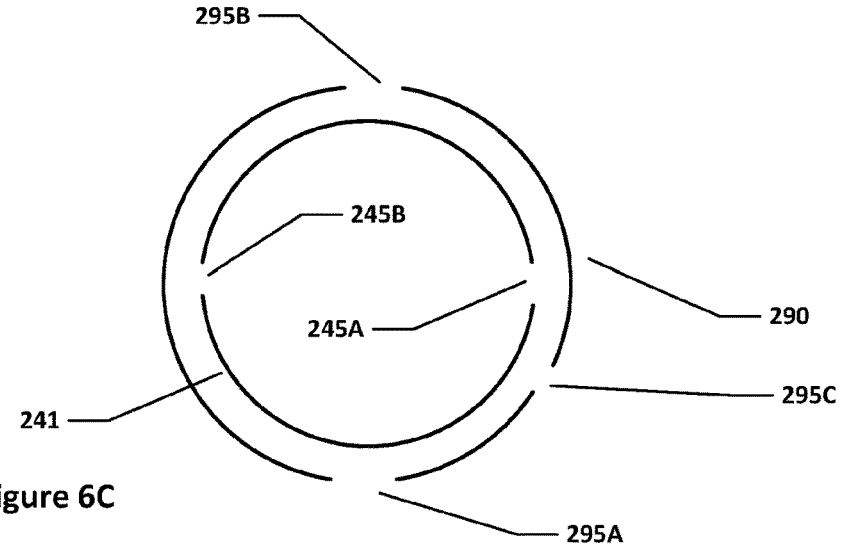

FIGS. 6A, 6B and 6C are schematic diagrams showing the collar 290 in three different azimuthal (rotational) positions with respect to the shaft 241. In the position of FIG. 6A, the two holes or openings 245A and 245B of the body connector 240 are both aligned with corresponding openings or notches in the collar 290, namely openings 295A and 295B respectively. In this configuration, air can therefore enter the e-cigarette 10 through both openings 245A and 245B (via openings 295A and 295B respectively). In contrast, notch 295C in the collar 290 is not aligned with any corresponding opening in the shaft 241, and hence no air is able to enter within the e-cigarette 10 through notch 295C.

In the position of FIG. 6B, the collar 290 has been rotated in a clockwise direction with respect to the shaft 241, so that the two holes or openings 245A and 245B are no longer aligned with openings 295A and 295B respectively. However, notch 295C has now been rotated to align with opening 295A. Accordingly, in this configuration, air can enter the e-cigarette 10 through opening 245A (via opening 295C), but not through opening 245B, and no air is able to enter the inside of the e-cigarette 10 through notches 295A and 295B.

Lastly, in the position of FIG. 6C, the collar 290 has been further rotated in a clockwise direction with respect to the shaft 241, so that none of the openings 245A and 245B in the shaft 241 is aligned with an opening 295A, 295B, 295C in the collar 290. Accordingly, in this position or orientation, air is prevented from entering the e-cigarette 10 through collar 290 and shaft 241.

In some implementations, a user may still be able to inhale through the e-cigarette 10 even when in the configuration of FIG. 6C—for example, the e-cigarette 10 may be provided elsewhere with one or more additional air inlet holes (apart from openings 295A, B and C); alternatively (or additionally) there may be air ingress for example at the join between the body 20 and the cartomizer 30. However, if such alternative air inlet options are not provided in the e-cigarette 10, then the configuration of FIG. 6C can be considered, in effect, as a form of "off" position, in that the user will no longer be able to inhale through the e-cigarette 10 in this position. The e-cigarette 10 may be provided with external markings to indicate this "off" position to a user. In addition, the collar 290 may be resiliently biased to return to this "off" position, for example, as some form of safety mechanism.

In other implementations, the user may still be able to inhale through the e-cigarette 10 in the configuration of FIG. 6C, but such inhalation might not be detectable by sensor 215—for example, because the amount of airflow is too weak (i.e. below some threshold setting for sensor 215) and/or because the airflow from points of air ingress into the e-cigarette 10 is arranged to have a different routing (not past the sensor 215). In such a situation, although a user can inhale, the heater 365 is not activated, and therefore no nicotine vapor is produced. In these circumstances, the configuration of FIG. 6C would again represent, in effect, an "off" position.

Figure 7:
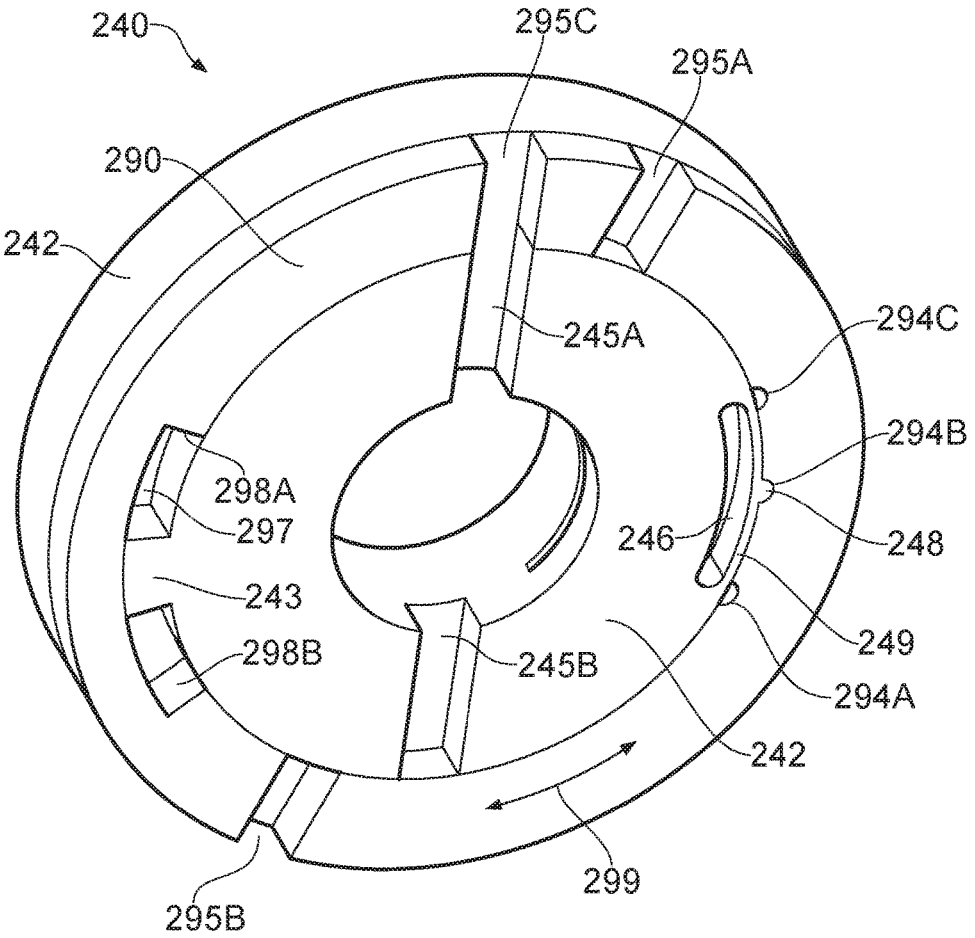
FIG. 7 is a schematic diagram showing a collar or sleeve fitted around a part of the body of the e-cigarette of FIG. 1 in accordance with some embodiments of the disclosure.

FIG. 7 is a schematic illustration that further indicates how the collar 290 and body connector 240 permit air to flow into the e-cigarette 10 in accordance with various embodiments of the disclosure. There are some differences between the implementation shown in FIG. 7 compared with the implementation shown in FIG. 5. Thus in FIG. 7 the shaft portion of 241 of the body connector 240 does not extend past the outwardly directed lip portion 242 (in an axial direction towards the mouthpiece). In addition, the notches 295A, 295B and 295C in FIG. 5 are located at the boundary between the collar 290 and the external housing 201, whereas the notches 295A, 295B and 295C in FIG. 7 are located at the boundary between the collar 290 and the lip portion 242 of the body connector 240. Consequently, the notches 295A, 295B and 295C in FIG. 5 can be considered as extending into the collar 290 in an axial direction towards the mouthpiece 35, whereas the notches 295A, 295B and 295C in FIG. 7 can be considered as extending into the collar 290 in an axial direction towards the cap 225. It will be appreciated by the skilled person that both such arrangements (and indeed any intermediate positionings) are able to provide variable ventilation to the vaporizer as described herein.

Furthermore, while FIG. 7 is sectioned, like FIG. 5, in a plane transverse to the longitudinal axis LA of the e-cigarette 10, the positioning of this sectioning is slightly different from FIG. 5. In particular, this sectioning goes through the collar 290 as well, so there is a portion of the collar 290 (extending axially towards the cap 225) that is omitted from FIG. 7 (the corresponding portion of the shaft 241 that passes inside this collar 290, and also the portion of the shaft 241 that passes inside the external housing 201, are likewise omitted by this sectioning of FIG. 7). At least some of this omitted portion of the collar 290 may be azimuthally (circumferentially) complete, i.e. notches 295A, 295B and 295C do not extend the full length of the collar 290 in an axial direction LA. This then allows the collar 290 to comprise a single unit, which can assist with easier fabrication.

Nevertheless, the implementation shown in FIG. 7 shares the same general configuration of FIGS. 5 and 6, in that the collar 290 is provided with three holes or notches 295A, 295B and 295C, two of which (295A and 295B) are diametrically opposite one another, while the third notch (295C) is circumferentially offset from the other two. Similarly, the shaft 241 of the body connector 240 has two openings (245A, 245B) which are again diametrically opposite one another. The collar can be rotated around the shaft 241 as indicated by the arrow 299 into the three angular positions shown in FIGS. 6A, 6B and 6C. These three positions correspond to two air holes (245A, 245B) in the body connector 240 being open (as per the position of FIG. 6A, and also as shown in FIG. 5); one of the two air holes (245A) in the body connector 240 being open (as per the position of FIG. 6B, and also as shown in FIG. 7); and none of the two air holes in the body connector 240 being open (as per the position of FIG. 6C).

Note that being able to control the airflow adjustment by moving collar 290, which is located circumferentially around, but separate from (in effect, external to) the main housing of the e-cigarette 10, such as shaft 241, has certain benefits. Thus the collar 290 only extends a relatively short distance in the axis direction (LA) compared to other components of the e-cigarette 10, such as the body 20 or cartomizer 30. This allows the collar 290 to be relatively lightweight and easy for a user to rotate. In addition, rotating the collar 290 rather than an underlying component, such as the body 20 or cartomizer 30, does not impact the connection 25A, 25B between the body 20 and the cartomizer 30, which can therefore remain intact.

It will also be appreciated that the configuration of FIG. 6A allows multiple holes on the collar 290 to be aligned respectively with multiple holes on the shaft 241, i.e. as shown in FIG. 6A, hole 295B is aligned with hole 245B, and hole 295A is aligned with hole 245A. Having multiple such through-holes (i.e. going through both the collar 290 and shaft 241) reduces the risk of a user accidentally blocking the airflow when holding the e-cigarette 10 with their fingers. Although FIG. 6A shows two such through-holes, other embodiments may provide additional through-holes (according to the particular setting of the collar 290) to further reduce the risk of occlusion by a user's finger(s).

Compared with the implementation shown in FIG. 5, the implementation of FIG. 7 has some additional features to provide greater control over the rotation of the collar 290 about the shaft 241. One of these features provides a small ridge, bump or other protrusion 248 formed on the radially outer surface of the shaft 241, i.e. on the surface of the shaft 241 that abuts against the inner radial surface of the collar 290. This inner radial surface of the collar 290 is provided with three, azimuthally (circumferentially) spaced incisions or indentations 294A, 294B and 294C. As the collar is rotated about the shaft 241, as indicated by arrow 299, the outward protrusion 248 on the shaft 241 may be received into any one of the indentations 294A, 294B and 294C. For example, FIG. 7 shows the protrusion 248 received into the middle indentation 294B.

The three indentations 294A, 294B and 294C therefore define, in effect, three predetermined relative angular positions between the collar 290 and the shaft 241. When the protrusion 248 is received into one of these indentations 294A, 294B or 294C, the collar 290 and shaft 241 are thereby held or latched (positively engaged) into the corresponding or respective predetermined relative angular position. In particular, when held in any of these predetermined positions, the engagement of the protrusion with corresponding indentation prevents the collar 290 from being able to rotate freely or easily around the shaft 241. The collar 290 therefore remains in that predetermined angular position relative to the shaft 241 unless the user takes a particular action, e.g. applies sufficient torque, to disengage the protrusion 248 from the indentation 294A, 294B or 294C (as described in more detail below).

The predetermined positions of the three indentations 294A, 294B and 294C are arranged to correspond to the three configurations shown in FIGS. 6A through to 6C. Thus FIG. 6A corresponds to protrusion 248 located in indentation 294A, whereby both of air holes 245A and 245B are open for ventilation through the collar 290; FIG. 6B corresponds to protrusion 248 located in indentation 294B, whereby only one of the air holes 245A is open for ventilation through the collar 290 (as shown in FIG. 7); and FIG. 6C corresponds to protrusion 248 located in indentation 294C, whereby neither of air holes 245A and 245B is open for ventilation through the collar 290. Accordingly, the user is provided with tactile feedback (a positive engagement or latching click, which may also provide audible feedback) as the collar 290 is rotated around the sleeve to each of the three ventilation levels as represented by the positioning of indentations 294A, 294B and 294C, and moreover the collar 290 will remain in that engaged position as selected by the user unless or until the user makes a positive decision to rotate the collar to a different predetermined engagement position. Note that in some embodiments, the exterior surface of the e-cigarette 10, in particular the collar 290 plus the lip 242 and/or external housing 201, may be provided with some visual marking or indication of the engagement positions, or at least an indication of which rotational direction for the collar 290 increases or decreases the level of ventilation.

It can be seen from FIG. 7 that there is a hollow portion 246 in the wall of the shaft 241 immediately below (radially inside) the notch 248. This hollow portion 246 extends a short distance in an azimuthal direction around the shaft 241, and defines in effect a bridge or span 249 in the outer portion of the shaft 241. The outward protrusion 248 is located off this bridge 249 in approximately the middle portion of the bridge 249 (as determined in a circumferential direction). The hollow portion 246 introduces some flexibility or resilience into the position of the protrusion 248. In particular, the default position for the bridge 249 may be as shown in FIG. 7, with the protrusion 248 located within one of the indentations 294A, 294B or 294C. However, if the user wishes to rotate the collar 290 to a different predetermined engagement position, then if they apply a sufficient rotational force (torque), the bridge 249 is able to deform resiliently by bending slightly into the hollow portion 246. This allows the protrusion 248 to disengage from the indentation by moving slightly radially inwards, and then to rotate along the inside of the collar 290 to the new desired engagement position. When this position is reached, the resilient nature of the bridge 249 pushes the protrusion 248 radially outwards again into the corresponding indentation 294, thereby allowing the bridge 249 to resume its default position as shown in FIG. 7 and thereby latching the collar 290 into the new predetermined engagement position. In other implementations, the material of the collar 290 and/or the shaft 241 may have sufficient elasticity to allow the hollow portion 246 to be omitted (or some other design may be adopted to provide the desired resilience).

FIG. 7 also illustrates that the inner radial surface of the collar 290 is provided with a circumferentially extending opening or slot 297. The azimuthal limits of this opening 297 are defined by radially directed walls 298A, 298B formed in the collar 290—i.e. these walls 298A, 298B are perpendicular to their local circumferential or tangential direction about the longitudinal axis LA. The shaft 241 has a tab, tooth or lug 243 (etc) directed in a radially outwards direction which is located within the opening 297. As the collar 290 is rotated with respect to the shaft 241, the tab 243 moves within (circumferentially along) the slot 297. This rotational movement of the tab 243 is limited by the two walls 298A, 298B in the collar 290. In particular, further rotation of the collar 290 in one direction (clockwise in the implementation of FIG. 7) is prevented when the tab 243 abuts against wall 298A, while further rotation of the collar 290 in the opposite direction (anti-clockwise in the implementation of FIG. 7) is prevented when the tab 243 abuts against wall 298B.

In the implementation of FIG. 7, the position of the tab 243 abutting against wall 298A corresponds to an angular orientation of the collar 290 with respect to the shaft 241 such that the protrusion 248 is located within indentation 294A. It will appreciated that further rotation of the collar 290 in the clockwise direction (in the configuration of FIG. 7) is not needed, since the other predetermined engagement positions, as determined by the positions of indentations 294B and 294C, lie in an anti-clockwise direction with respect to indentation 294A. Similarly, the position of the tab 243 abutting against wall 298C corresponds to an angular orientation of the collar 290 with respect to the shaft 241 such that the protrusion 248 is located within indentation 294C. Further rotation from this position of the collar 290 in the counter-clockwise direction is not needed, since the other predetermined engagement positions, as determined by the positions of indentations 294B and 294A, lie in a clockwise direction with respect to indentation 294C.

Accordingly, the interaction of lug 243 with slot 297, and in particular with end walls 298A and 298B, serves to limit the rotation of the collar 290 with respect to the shaft 241 to a predetermined range (corresponding to the angular separation of the end walls 298A and 298B less the angular width of the tab 243). This predetermined range is set, in the implementation of FIG. 7, to encompass the set of predetermined engagement positions (offering the corresponding particular levels of ventilation), such that rotation of the collar 290 around the shaft 241 is permitted within the circumferential range of the predetermined engagement positions, but is not permitted outside this circumferential range. One effect of this restriction is to prevent a 360 degree rotation of the collar 290 with respect to the shaft 241. This makes it generally easier to operate the device 10, since the user always encounters the predetermined engagement positions in a consistent ordering and spacing (one direction to increase ventilation, the other to decrease ventilation), which would not be the case if full circular rotation of the collar 290 about the body connector 240 was permitted. However, other implementations may omit the lug 243 and associated slot 297 to permit 360 degree rotation of the collar 290 with respect to the shaft 241 (for example, to simplify the construction of the electronic vapor provision system).

Thus various embodiments as described herein provide an electronic vapor provision system, for example, an e-cigarette 10 or other type of such device, for providing nicotine or other vapors to a user. Such an electronic vapor provision system has a housing and a vaporizer (such as a heater) contained within the housing. A mouthpiece is located at one end of the system to provide an air outlet. A user can inhale or draw on the mouthpiece to receive vapor from the electronic vapor provision system.

The air inlet (which may comprise multiple openings) into the housing is provided with a facility to control ventilation as described herein. This air inlet is located upstream of the vaporizer, so that the ventilation control described herein alters the flow of air past the vaporizer, e.g. heater 365. In general, allowing more ventilation increases the amount of vapor produced (and hence inhaled), since increased airflow past the heater removes the existing vapor and helps further liquid to vaporize from the heater. In other words, increasing the ventilation to allow more air to flow into the e-cigarette tends to increase the amount of nicotine content (or other vapor content) inhaled by a user out through mouthpiece 35.

The variable ventilation can also be used to adjust the draw resistance of the e-cigarette 10. Thus as a user inhales, the lungs in effect work against the draw resistance, i.e. the work required to pull air into and then through the e-cigarette 10 into the lungs. For most users, there is a range of draw resistance that helps them to perform a steady inhalation. However, if the draw resistance is too low, the inhalation may become too rapid and unsteady, while if the draw resistance is too high, the inhalation may become unduly burdensome. The most suitable level of draw resistance varies from one user to another user, based e.g. on physiological factors. Accordingly, providing variable ventilation as described herein can help a user to configure the draw resistance of e-cigarette 10 to an appropriate value for their own personal preferences and characteristics.

Note that the housing may comprise multiple different components. Unless otherwise indicated, a component may generally be considered as part of the housing if it contributes to preventing the ingress of air from outside the electronic vapor provision system (other than in respect of any inlet holes). For example, in the embodiment of FIG. 4, the external housing 201 and the body connector 201 both form part of the housing. In addition, the housing may contain both a body portion 20, which includes at least a power source for the vaporizer, and a vaporizer portion 30 including the vaporizer. In some implementations, for example as shown in FIG. 1, the electronic vapor provision system has a first state in which the body portion is detached from the vaporizer portion, and a second state in which the body portion has a rigid connection to the vaporizer portion. This rigid connection, which may be achieved by any suitable mechanism, for example, a screw fit, a snap fit, a bayonet fitting, etc, prevents movement, in the second state, of the body portion relative to the vaporizer portion (other than to detach the vaporizer portion from the body portion into the first state). Note that in other embodiments the housing may, for example, contain three detachable portions, namely a body portion (containing a power cell), a vaporizer portion (containing a vaporizer) and a cartridge (containing a fluid reservoir). In other embodiments, these components (power cell, vaporizer and fluid reservoir) may be integrated into a single unit within an overall housing, and are not intended to be detached or separated by a user.

One or more air inlet holes are provided in a portion of the housing. In response to a user inhalation at the mouthpiece, air flows into the system through the one or more air inlet hole, passing the vaporizer, which introduces vapor into the airflow, and out through the mouthpiece. An air inlet hole may have any appropriate shape, for example, it may be circular, or elongate (such as a slot), etc. If multiple air inlet holes are provided in the portion of housing, they may all be the same as one another, or they may vary in shape, size and/or orientation.

In the example of FIG. 4, the portion of the housing having the one or more air inlet holes is located on the body portion 20 of the electronic vapor provision system, adjacent to the connection to the vaporizer portion (cartomizer) 30. However, in other embodiments this portion of the housing may be located elsewhere, for example on the cartomizer itself, and/or away from the connection 25. In addition, the electronic vapor provision system may be provided with one or more additional air inlet holes not in said housing portion, but rather in a different location, such as at or near cap 225, as described above in relation to the embodiment of FIG. 2.

The electronic vapor provision system further includes a collar located around the portion of the housing that contains the one or more air inlet holes—for example, collar 290 as shown in FIG. 4. The collar is movable with respect to the housing. Moving the collar relative to the housing results in different degrees of alignment between the collar and the one or more air inlet holes of the housing, thereby changing the properties of the airflow into the electronic vapor provision system. Moreover, the system further includes a mechanism for positively engaging the collar and the housing at a plurality of predetermined positions as the collar is moved with respect to the housing. Different ones of said plurality of predetermined positions therefore correspond to providing different levels of ventilation into the system.

A user is therefore able to control the degree of ventilation into the system by moving the collar as appropriate to one of the predetermined positions. This control over ventilation can be used to impact various significant operating parameters of the system, such as draw resistance and volume of airflow past the vaporizer (which in turn can impact properties such as the droplet size and density of the vapor introduced into the airflow). Furthermore, the positive engagement mechanism ensures that the collar remains in the selected position (and hence the desired operating parameters are maintained) unless or until the user decides to change the position of the collar—for example, because the device is being shared between multiple users, because the cartomizer portion has been replaced, or because the mood or condition of the user has changed.

The collar is generally located on the outside of the housing, such as shown in FIG. 4, since it is then readily accessible for a user to move the collar. The outer surface of the collar may be textured or raised above the surrounding level of the housing in order to further facilitate user movement of the collar. In addition, the collar and/or housing may be provided with some visual indication of which direction to move the collar in order to increase (or decrease) the ventilation into the electronic vapor provision system.

In some implementations, such as shown in FIG. 4, the collar may have a fixed location with respect to the longitudinal axis LA of the electronic vapor provision system, and the movement of the collar comprises rotation about this axis. Hence the predetermined positions in this configuration are predetermined angular positions of the collar relative to the housing portion. In this case, the axial extent of the collar may be generally commensurate with that of the housing portion containing the one or more air inlet holes.

In other embodiments, the movement of the collar may comprise sliding along the housing in a direction parallel to the longitudinal axis LA of the electronic vapor provision system. Another possibility is to provide a screw thread on the housing portion and/or the collar itself so that the collar has a screw (helical) movement along the housing, with the axis of the helix parallel to the longitudinal axis LA of the electronic vapor provision system. In these latter two cases, the axial extent of the collar may be generally somewhat shorter than that of the housing portion containing the one or more air inlet holes. Accordingly, in such embodiments, axial movement of the collar may be used to decrease or increase the occlusion of the one or more air inlet holes in the housing, and the predetermined positions reflect differing amounts of such axial movement.

In some embodiments, there are three or more predetermined positions for positive engagement between the collar and the housing. Increasing the number of such predetermined positions helps to provide increased granularity of control. One of the predetermined positions may have the collar aligned so as to prevent air from entering the electronic vapor provision system via any of the one or more air inlet holes of the housing portion. This predetermined position might be selected, for example, when the system is not in use, in order to prevent or to help reduce evaporation loss of nicotine (or other fluid) through the one or more air holes in the housing portion.

Note that the device may still be operational even when the collar is aligned so as to prevent air from entering the electronic vapor provision system via any of the one or more air inlet holes of the housing portion. For example, a user inhalation may draw airflow into the system through one or more additional air holes (not located in this housing portion), such as near cap 225, and/or through some leakage, for example, at the connection between the body portion and the vaporizer portion.

In some embodiments, different predetermined positions for engagement may have the collar positioned so as to allow air to enter through a different number of the one or more air inlet holes in the housing portion. In such a configuration each air inlet hole in the housing portion may be either fully open or fully shut in a given predetermined position. For example, in a system having three air inlet holes in the housing portion, a first predetermined position may have none of the air inlet holes in the housing portion open, a second predetermined position may have one of the air inlet holes in the housing portion open (and the other shut), and a third predetermined position may have all of the air inlet holes in the housing portion open. In other embodiments, the predetermined positions may involve partial opening of one or more air inlet holes. For example, in a system having one air inlet hole in the housing portion, a first predetermined position may have none of the air hole in the housing portion open, a second predetermined position may have the air inlet hole in the housing portion one-third open, a third predetermined position may have the air inlet hole in the housing portion two-thirds open, and a fourth predetermined position may have the air inlet hole in the housing portion fully open.

In some embodiments, the mechanism for positively engaging the collar and the housing at a plurality of predetermined positions comprises a male part on one of the collar or the housing and a plurality of female parts on the other of the collar or the housing. Each female part can receive the male part and corresponds to a respective one of the plurality of predetermined positions. For example, in the embodiment of FIG. 7, the male part comprises the protrusion 248 on the housing (body connector 240) having an outward direction, and the female parts comprise the set of corresponding indentations 294A, 294B and 294C on an inner surface of the collar. It will be appreciated that in other embodiments, the male part may be located on the inside of the collar, and the female parts on the outside of the housing. In addition, the nature of the male and female parts may vary according to the particular implementation. For example, if the collar is arranged to slide in an axial direction with respect to the housing, the male part may comprise a ridge extending part or all of the way around the circumference of the housing (i.e. in a plane perpendicular to the longitudinal axis LA), and the female parts may comprise corresponding circumferential grooves in the collar.

In some embodiments, the mechanism is configured to resiliently bias the collar and the housing into positive engagement at the plurality of predetermined positions as the collar is moved with respect to the housing. Such bias may be achieved using a suitable structure or configuration, such as the bridge or span 249 shown in FIG. 7. In other embodiments, such bias may rely primarily on the natural resilience of the material of the collar and/or the housing—e.g. a plastic collar may have sufficient natural resilience so as to be able to snap into and out of the different predetermined positions—and hence the bridge 249 (and associated hollow portion 246) may be omitted.

In some embodiments, the plurality of predetermined positions defines a range of movement of the collar with respect to the housing. The electronic vapor provision system may be configured to prevent movement of the collar with respect to the housing beyond said range. For example, in the embodiment of FIG. 7, movement of the collar with respect to the housing beyond the range of the predetermined positions is prevented by having the protrusion or lug 243 on the housing that abuts, at each end of the range, against a respective wall 298A, 298B on the collar. In other embodiments, in which the collar is movable in an axial direction relative to the housing, movement beyond the range of the predetermined positions may be prevented, for example, by providing outwardly directed ridges on the housing which the collar is unable to slide past. In other embodiments, there may be no restriction on the rotational movement of the collar with respect to the housing, so that 360 degree movement of the collar can be achieved around the longitudinal axis of the electronic vapor provision system.

In some embodiments, the collar itself is provided with one or more air inlet holes (these may be fully defined apertures, or indentations into the side of collar). In such an arrangement, movement of the collar relative to the air inlet holes of the housing portion may result in different degrees of overlap between the one or more air inlet holes of the housing portion and the one or more air inlet holes of the collar, which in turn produces different amounts of ventilation for the electronic vapor provision system. In other embodiments, the collar may not have any such air inlet holes. Instead, motion of the collar (such as along a longitudinal axis of the electronic vapor provision system) may cover or expose individual air inlet holes in the housing portion to adjust the ventilation.

In some embodiments, one of the plurality of predetermined positions provides an off setting for the electronic vapor provision system. This can help safety, in that it is more difficult to unintentionally activate the system in this setting, especially if the mechanism is resiliently biased to return to this predetermined position The off setting can be implemented in various ways. For example, if the mechanism provides no ventilation in the predetermined position of the off setting, and there are no other ventilation paths into and through the electronic vapor provision system, a user is unable to inhale through the device. In other implementations, at least some inhalation may be feasible through the device, but such inhalation may not provide sufficient airflow past the sensor to activate the vaporizer. In some cases this may be because the overall airflow through the e-cigarette is very small (or zero), because the ventilation is likewise reduced (or zero). Alternatively, some or all of the airflow may be routed away from the airflow sensor, and hence again there is not sufficient airflow past the sensor to activate the vaporizer. Such a situation may arise for example because the predetermined position of the off setting directs any airflow through the mechanism so that it does not pass the sensor. Alternatively, the predetermined position of the off setting may prevent air ingress through the mechanism itself, and other airflow routes (if any) through the e-cigarette substantially avoid the sensor.

Note that although the body portion and the vaporizer may be sold together as a complete electronic vapor provision system as described herein, in some cases the different components may be sold individually, for example, as replacement unit if the nicotine in a cartridge is exhausted. Accordingly, some embodiments provide a body portion or vaporizer for use in an electronic vapor provision system, where the body portion or vaporizer is provided with a collar such as described herein.

Some embodiments provide an electronic vapor provision system having one or more air inlet holes for drawing air into the system in response to a user inhalation and a variable ventilation mechanism having a plurality of predetermined settings, wherein each setting corresponds to a different degree of occlusion of the one or more air inlet holes, and the variable ventilation mechanism can be latched into any of said plurality of predetermined settings.

Although the embodiments described above have just one collar for controlling ventilation into the electronic vapor provision system, other embodiments may have multiple such collars, each being used to control the ventilation through one or more air inlet holes in a corresponding portion of the housing.

In order to address various issues and advance the art, this disclosure shows by way of illustration various embodiments in which the claimed invention(s) may be practiced. The advantages and features of the disclosure are of a representative sample of embodiments only, and are not exhaustive and/or exclusive. They are presented only to assist in understanding and to teach the claimed invention(s). It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope of the claims. Various embodiments may suitably comprise, consist of, or consist essentially of, various combinations of the disclosed elements, components, features, parts, steps, means, etc other than those specifically described herein. The disclosure may include other inventions not presently claimed, but which may be claimed in future.

The invention claimed is:

1. An electronic vapor provision system comprising:

a housing;

a vaporizer contained within the housing;

a mouthpiece at one end of said system, the mouthpiece providing an air outlet;

a body portion within the housing, the body including at least a power source for the vaporizer;

a vaporizer portion within the housing, the vaporizer portion including the vaporizer;

one or more air inlet holes provided in a portion of the housing that includes the body portion, whereby in response to a user inhalation at the mouthpiece, air flows into the system through the one or more air inlet holes, past the vaporizer, and out through the mouthpiece;

a collar located in the body portion around the portion of the housing in which the one or more air inlet holes are provided, the collar being movable by a user with respect to the housing; and a mechanism located in the body portion for positively engaging the collar and the housing at a plurality of predetermined positions as the collar is moved with respect to the housing, wherein different ones of said plurality of predetermined positions result in different degrees of alignment between collar and the one or more air inlet holes of the housing, thereby providing different levels of ventilation into the system;

wherein the electronic vapor provision system has a first state in which the body portion is detached from the vaporizer portion, and a second state in which the body portion has a rigid connection to the vaporizer portion, such that in the second state, movement of the body portion relative to the vaporizer portion is prevented other than to detach the vaporizer portion from the body portion into the first state.

2. The electronic vapor provision system of claim 1, wherein the collar is located adjacent to the connection between the body portion and the vaporizer portion.

3. The electronic vapor provision system of claim 1, wherein there are three or more predetermined positions for positive engagement between the collar and the housing.

4. The electronic vapor provision system of claim 1, wherein one of the predetermined positions has the collar aligned so as to prevent air from entering the electronic vapor provision system via any of the one or more air inlet holes of the housing portion.

5. The electronic vapor provision system of claim 1, wherein different predetermined positions for engagement have the collar positioned so as to allow air to enter through a different number of the one or more air inlet holes in the housing.

6. The electronic vapor provision system of claim 1, wherein the collar slides along the housing in a direction substantially aligned with a direction of airflow through the electronic vapor provision system to the mouthpiece.

7. The electronic vapor provision system of claim 1, wherein the collar rotates around the housing, and the plurality of predetermined positions are a plurality of predetermined angular positions of the collar with respect to the housing.

8. The electronic vapor provision system of claim 1, wherein the mechanism for positively engaging the collar and the housing at a plurality of predetermined positions comprises a male part on one of the collar or the housing and a plurality of female parts on the other of the collar or the housing, wherein each female part can receive the male part and corresponds to a respective one of the plurality of predetermined positions.

9. The electronic vapor provision system of claim 8, wherein the male part comprises a protrusion on the housing having an outward direction, and each female part comprises a corresponding indentation on an inner surface of the collar.

10. The electronic vapor provision system of claim 1, wherein the mechanism is configured to resiliently bias the collar and the housing into positive engagement at the plurality of predetermined positions as the collar is moved with respect to the housing.

11. The electronic vapor provision system of claim 1, wherein the plurality of predetermined positions define a range of movement of the collar with respect to the housing, and wherein the electronic vapor provision system is configured to prevent movement of the collar with respect to the housing beyond the range.

12. The electronic vapor provision system of claim 11, wherein movement of the collar with respect to the housing beyond the range is prevented by having a protrusion on one of the collar or the housing, and wherein the protrusion abuts, at each end of the range, against a respective wall on the other one of the collar or the housing.

13. The electronic vapor provision system of claim 1, wherein the collar is provided with one or more air inlet holes, and the different degrees of alignment between the collar and the one or more air inlet holes of the housing portion provide different degrees of overlap between the one or more air inlet holes of the housing portion and the one or more air inlet holes of the collar.

14. The electronic vapor provision system of claim 13, wherein the collar is provided with two or more air inlet holes and the housing is provided with two or more air inlet holes, and wherein for at least one or more of the plurality of predetermined positions, multiple air inlet holes on the collar are respectively aligned with multiple air inlet holes in the housing.

15. The electronic vapor provision system of claim 1, wherein one of the plurality of predetermined positions provides an off setting for the electronic vapor provision system.

16. The electronic vapor provision system of claim 15, wherein no ventilation is provided for the off setting.

17. The electronic vapor provision system of claim 15, further comprising a sensor to detect air flow for activating the vaporizer, wherein the sensor does not detect an air flow for the off setting.

18. The electronic vapor provision system of claim 1, wherein the vaporizer serves to produce vapor from a liquid held within the electronic vapor provision system, and wherein engaging the collar and the housing into a predetermined position to increase ventilation into the electronic vapor provision system causes an increase in vapor content inhaled by a user through the mouthpiece.

19. The electronic vapor provision system of a claim 1, wherein the different levels of ventilation allow a user to configure a draw resistance for the electronic vapor provision system.

20. A body portion for an electronic vapor provision system which includes a vaporizer portion which is connectable to the body portion, the vaporizer portion including a vaporizer and a mouthpiece at one end opposite to the body portion, the mouthpiece providing an air outlet from the electronic vapor provision system, the body portion comprising:

a housing;

a power source for the vaporizer;

one or more air inlet holes provided in a portion of the housing, whereby in response to a user inhalation at the mouthpiece, air flows into the electronic vapor provision system through the one or more air inlet holes;

a collar located around the portion of the housing in which the one or more air inlet holes are provided, the collar being movable with respect to the housing; and a mechanism for positively engaging the collar and the housing at a plurality of predetermined positions as the collar is moved with respect to the housing, wherein different ones of the plurality of predetermined positions result in different degrees of alignment between the one or more air inlet holes of the housing and the collar, thereby providing different levels of ventilation into the system.

21. An electronic vapor provision system comprising:

a housing;

a vaporizer contained within the housing;

a mouthpiece at one end of the [system, the mouthpiece providing an air outlet;

one or more air inlet holes provided in a portion of the housing, whereby in response to a user inhalation at the mouthpiece, air flows into the system through the one or more air inlet holes, past the vaporizer, and out through the mouthpiece;

a collar located around the portion of the housing in which the one or more air inlet holes are provided, the collar being movable by a user with respect to the housing; and a mechanism for positively engaging the collar and the housing at a plurality of predetermined positions as the collar is moved with respect to the housing, wherein different ones of the plurality of predetermined positions result in different degrees of alignment between collar and the one or more air inlet holes of the housing, thereby providing different levels of ventilation into the system;

wherein the mechanism for positively engaging the collar and the housing at a plurality of predetermined positions comprises a male part on one of the collar or the housing and a plurality of female parts on the other of the collar or the housing, wherein each female part can receive the male part and corresponds to a respective one of the plurality of predetermined positions.

22. An electronic vapor provision system comprising:

a housing;

a vaporizer contained within the housing;

a mouthpiece at one end of the system, the mouthpiece providing an air outlet;

two or more air inlet holes provided in a portion of the housing, whereby in response to a user inhalation at the mouthpiece, air flows into the system through the two or more air inlet holes, past the vaporizer, and out through the mouthpiece;

a collar located around the portion of the housing in which the two or more air inlet holes are provided, the collar being movable by a user with respect to the housing; and a mechanism for positively engaging the collar and the housing at a plurality of predetermined positions as the collar is moved with respect to the housing, wherein different ones of the plurality of predetermined positions result in different degrees of alignment between collar and the two or more air inlet holes of the housing, thereby providing different levels of ventilation into the system;

wherein the collar is provided with two or more air inlet holes, and the different degrees of alignment between the collar and the two or more air inlet holes of the housing portion provide different degrees of overlap between the two or more air inlet holes of the housing portion and the with two or more air inlet holes of the collar;

and wherein for at least one or more of the plurality of predetermined positions, multiple air inlet holes on the collar are respectively aligned with multiple air inlet holes in the housing.

23. The electronic vapor provision system of claim 1, wherein the electronic vapor provision system is an e-cigarette.

* * * * *